US010488135B2

(12) United States Patent
Mueller et al.

(10) Patent No.: US 10,488,135 B2
(45) Date of Patent: Nov. 26, 2019

(54) COCKING DEVICE FOR A FIRING PIN AND WEAPON COMPRISING SAID COCKING DEVICE

(71) Applicant: RHEINMETALL WAFFE MUNITION GMBH, Unterluess (DE)

(72) Inventors: Andy Mueller, Villingendorf (DE); Hubert Schneider, Dietingen (DE); Markus Schweizer, Dornhan-Weiden (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 16/196,375

(22) Filed: Nov. 20, 2018

(65) Prior Publication Data

US 2019/0093972 A1 Mar. 28, 2019

Related U.S. Application Data

(60) Division of application No. 16/008,670, filed on Jun. 14, 2018, now Pat. No. 10,401,109, which is a continuation of application No. PCT/EP2016/080999, filed on Dec. 14, 2016.

(30) Foreign Application Priority Data

Dec. 14, 2015 (DE) ..... 10 2015 121 770

(51) Int. Cl.

| | |
|---|---|
| ***F41A 19/34*** | (2006.01) |
| ***F41A 3/44*** | (2006.01) |
| ***F41A 17/42*** | (2006.01) |
| ***F41A 17/66*** | (2006.01) |
| ***F41A 19/31*** | (2006.01) |

(52) U.S. Cl.

CPC ..... *F41A 19/34* (2013.01); *F41A 3/44* (2013.01); *F41A 17/42* (2013.01); *F41A 17/66* (2013.01); *F41A 19/31* (2013.01)

(58) Field of Classification Search

USPC ..... 42/70.08

See application file for complete search history.

(56) References Cited

U.S. PATENT DOCUMENTS

| | | | |
|---|---|---|---|
| 2,716,923 | A | 9/1955 | Gaidos |
| 3,287,842 | A | 11/1966 | Denhoff |
| 5,722,194 | A | 3/1998 | Wü rger et al. |
| 9,121,654 | B2 | 9/2015 | Arnedo Vera et al. |

FOREIGN PATENT DOCUMENTS

| | | | |
|---|---|---|---|
| DE | 19600459 | A1 | 7/1997 |
| DE | 29922251 | U1 | 4/2001 |
| DE | 102007048468 | A1 | 4/2009 |

(Continued)

OTHER PUBLICATIONS

International Search Report dated May 4, 2017 in corresponding application PCT/EP2016/080999.

*Primary Examiner* — Reginald S Tillman, Jr.

(74) *Attorney, Agent, or Firm* — Muncy, Geissler, Olds & Lowe, P.C.

(57) ABSTRACT

A cocking device for a firing pin spring of a firing pin of a weapon, the firing pin being integrated into a breech. This firing pin spring is cocked during the pre-run of the control slide, by means of a cocking slide on the weapon, said cocking slide having a cocking curve, in which a pin of a cocking rocker is engaged.

8 Claims, 4 Drawing Sheets

(56) References Cited

FOREIGN PATENT DOCUMENTS

| | | | |
|---|---|---|---|
| DE | 102009011939 | A1 | 9/2010 |
| DE | 102014108469 | A1 | 12/2015 |
| EP | 2759798 | A2 | 7/2014 |
| EP | 2803933 | A1 | 11/2014 |
| GB | 125470 | A | 4/1919 |
| JP | H07159090 | A | 6/1995 |

COCKING DEVICE FOR A FIRING PIN AND WEAPON COMPRISING SAID COCKING DEVICE

This nonprovisional application is a divisional application of U.S. application Ser. No. 16/008,670, which was filed on Jun. 14, 2018, which is a continuation of International Application No. PCT/EP2016/080999, which was filed on Dec. 14, 2016, and which claims priority to German Patent Application No. 10 2015 121 770.8, which was filed in Germany on Dec. 14, 2015, and which are all herein incorporated by reference.

BACKGROUND OF THE INVENTION

Field of the Invention

The present invention relates to a firing pin in a breech system and with a cocking device for tensioning a firing pin spring and a firing pin safety device. Such firing pins are used in externally powered but also self-powered weapons, such as for example small- and medium-caliber weapons, the firing pin being integrated in the breech or breech head.

Description of the Background Art

DE 196 00 459 A1, which corresponds to U.S. Pat. No. 5,722,194, proposes a breech for a firing weapon that unlocks the breech head from the release catch at the end of the barrel of the weapon during a return movement of a breech bolt handle and locks it during the advancement. The breech head has lugs at an angle to the axis, whereby a rotating movement is caused during the unlocking and locking operation of the breech head from the release catch of the barrel. Furthermore, a rotary bolt is known from DE 299 22 251 U1.

DE 10 2009 011 939 A1 concerns a locking device for a simple breech system, in particular for an externally powered or self-powered weapon. Here, the breech or breech carrier is engaged under and therefore locked by a wedge-like block that can be displaced vertically in relation to the breech, so that a positively locking connection is produced. Vertically is considered here to mean all directions that are technically possible in the weapon, such as vertically from below, vertically from the side or vertically from above. Also proposed is a triggering mechanism with a safety device, which comprises a kinematic mechanism which is made up of a first lever mounted about a pivot point in the manner of a rocker and a second lever mounted about a further pivot point and interacting with a sear. Integrated in this kinematic mechanism are two safety devices, which only allow a shot to be fired when the falling-block breech action has been properly locked. This second safety device is realized by a further lever engaging under a firing pin system as a safety device parallel to the first safety device. This lever interacts with the kinematic mechanism, for which purpose a movable component that functionally connects the lever to the kinematic mechanism is incorporated. When locking of the breech has taken place, the movable component rests on the lever arm of the first (lower) lever of the kinematic mechanism. This ensures that over a displacement path the (upper) engagement moves away. Since the safety device lever has also released the firing pin system, the firing pin system with the firing pin is moved in a spring-assisted manner over the displacement path to be traveled by the firing pin for activating the percussion cap. This triggering mechanism forms the striking mechanism for the firing pin.

A firing pin that is already cocked into its rear position during the return of the breech, by the tensioning of a firing pin spring already taking place during the transport of the breech in the backward direction, is often undesired.

DE 10 2014 108 469.1, discloses a breech with a breech carrier and a breech head and also with a separate striking mechanism for triggering the firing pin incorporated in the breech head. The striking mechanism has at least one lever, preferably two levers, for engaging under a spring-tensioned sear. A rear cocking ramp and a front ramp on the breech carrier serve for tensioning the spring of the sear in the striking mechanism and also additionally for pressing the at least one lever to disengage it from under the sear to release the sear. In the breech head, a firing pin safety device is also incorporated in the firing pin. This design obviates the need for an otherwise necessary firing pin spring. The firing pin can however only be fired without a cartridge when the breech head has been locked in the weapon by turning.

SUMMARY OF THE INVENTION

It is therefore an object of the present invention to provide a possible way in which it is not necessary to dispense with a firing pin spring, but no longer has the other disadvantages.

In an exemplary embodiment, the invention is based on the concept of only tensioning a firing pin spring for a firing pin when a breech or breech head advances (seen in the direction of firing). This takes place by a control cam for the cocking that is incorporated in a cocking slide.

This can be based on a breech feed according to DE 10 2009 011 909 A1,which is incorporated herein by reference, which comprises a control slide that is guided longitudinally movably in relation to the weapon housing. This slide preferably has a front control cam and a rear control cam on both sides. With the front control cam, a breech block is controlled, with the rear control cam a safety device for the firing pin. Other breech systems are likewise conceivable.

The cocking slide is preferably moved along with this control slide for the tensioning and relaxing of the firing pin spring. Forcibly guided in the cocking cam is a cocking pushrod, which serves the purpose of tensioning the firing pin spring during the forward movement of the breech. The cocking pushrod is for its part moved for example by means of a cocking rocker, which for its part has a cocking pin that is guided within the guide. The cocking rocker has a fixed pivot point of its own.

In one position, when the breech is in its rear position (also known as the transporting position), this firing pin spring is relaxed. The tensioning of the spring of the firing pin in the forward movement of the control carriage and release of the same achieve the effect that the firing of the shot takes place independently of the speed of advancement of the breech, and consequently independently of the cadence. This is made possible by the tensioning taking place during the advancement of the breech and firing taking place in the rest position of the breech.

The return of the firing pin takes place by a carrier dog, which acts on the firing pin and is carried along with the breech in a forcibly guided manner.

The cocking slide also serves for the actual firing of a shot. A slope or ramp on the cocking slide is responsible for the actual firing of a shot. The ramp determines the triggering time. The later the ramp meets the trigger, the later a shot is fired. The ramp presses a trigger upwardly away by means of a roller. A catching edge of the trigger is pressed by a catching edge of a catching pawl holding the firing pin and releases the catching edge of the catching pawl. As a result of the spring pretensioning of the catching pawl with respect to the trigger, the catching pawl slides away and for its part releases the firing pin. This firing pin, then unsecured in this position, moves forward under spring force of the firing pin spring and strikes a primer of the ammunition and ignites it.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

and

Figure 5:
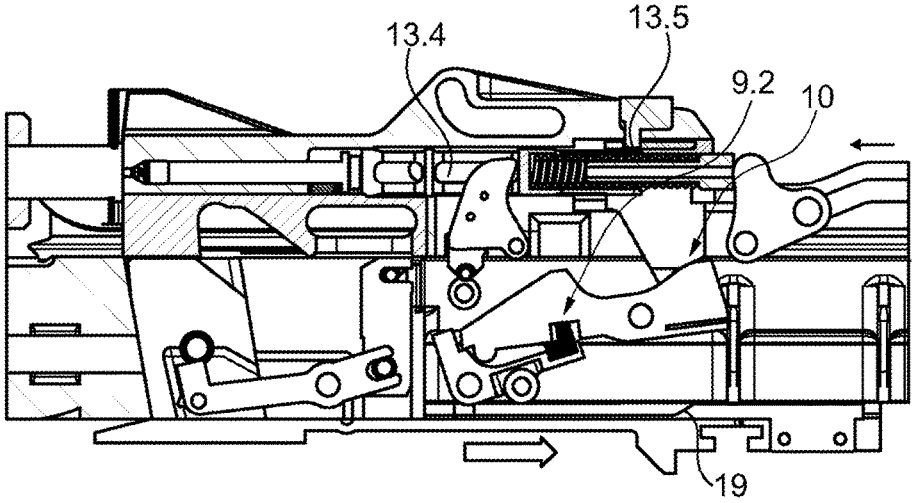

FIG. 5 shows a sectional representation with a relaxed firing pin spring.

DETAILED DESCRIPTION

Right, left, forward and backward are as seen in the direction of firing and defined as such.

Represented in the figures is a weapon 100, with a breech 1 or breech head, also known as a breech bolt. The feeding of the breech 1 takes place for example by way of a control carriage 2, which encloses a weapon housing 3 of the weapon 100, preferably in a U-shaped manner. Controlled with this control carriage 2 is a locking latch 4, here a falling-block action, which locks the breech 1 in the firing position. Delivered to the breech 1 in the the rear position of the breech 1 in the weapon 100 is an ammunition 5, which during the forward movement is introduced into a cartridge chamber 6 of the weapon 100.

Figure 1:
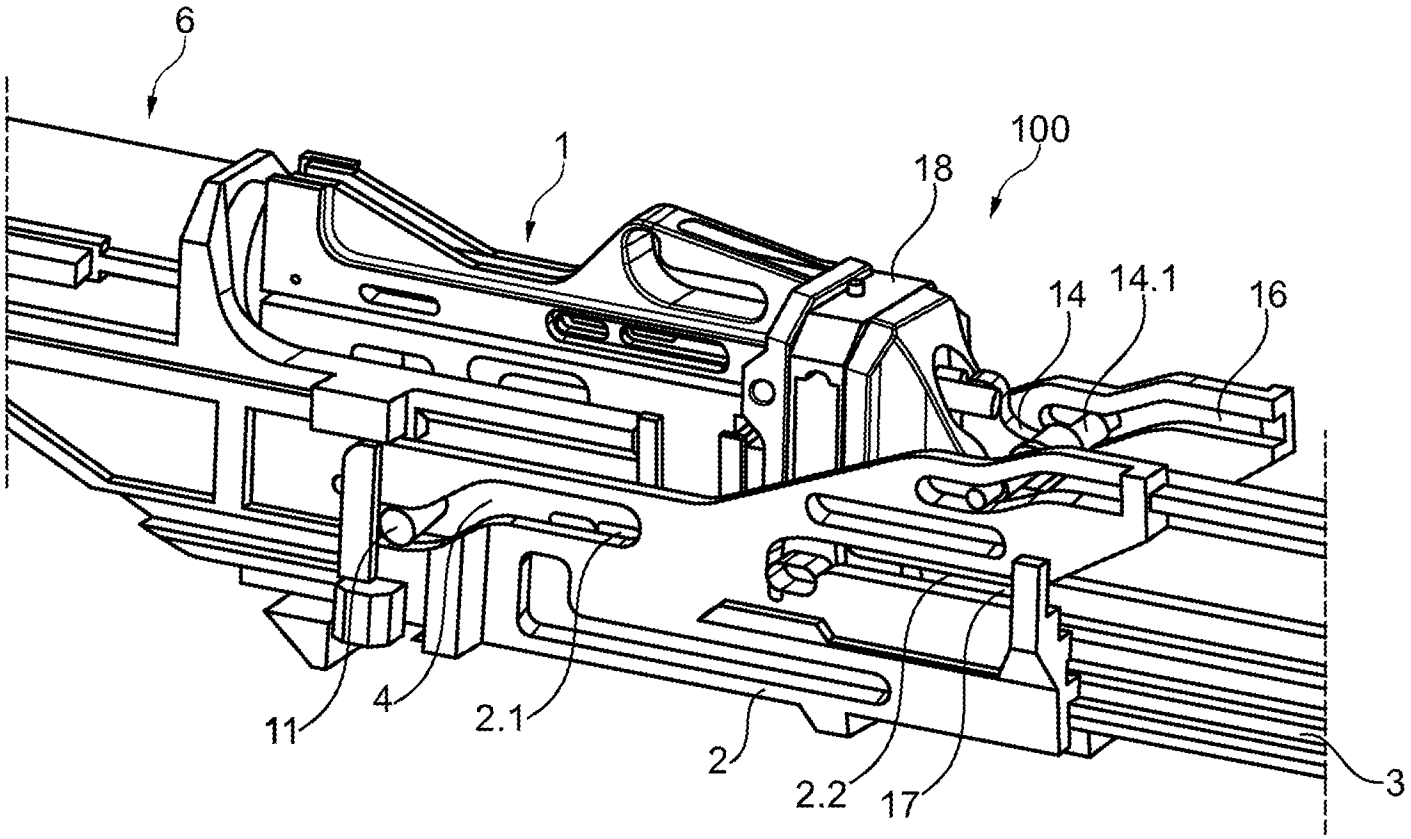
FIG. 1 shows a slightly perspective representation of an indicated weapon.
Figure 2:
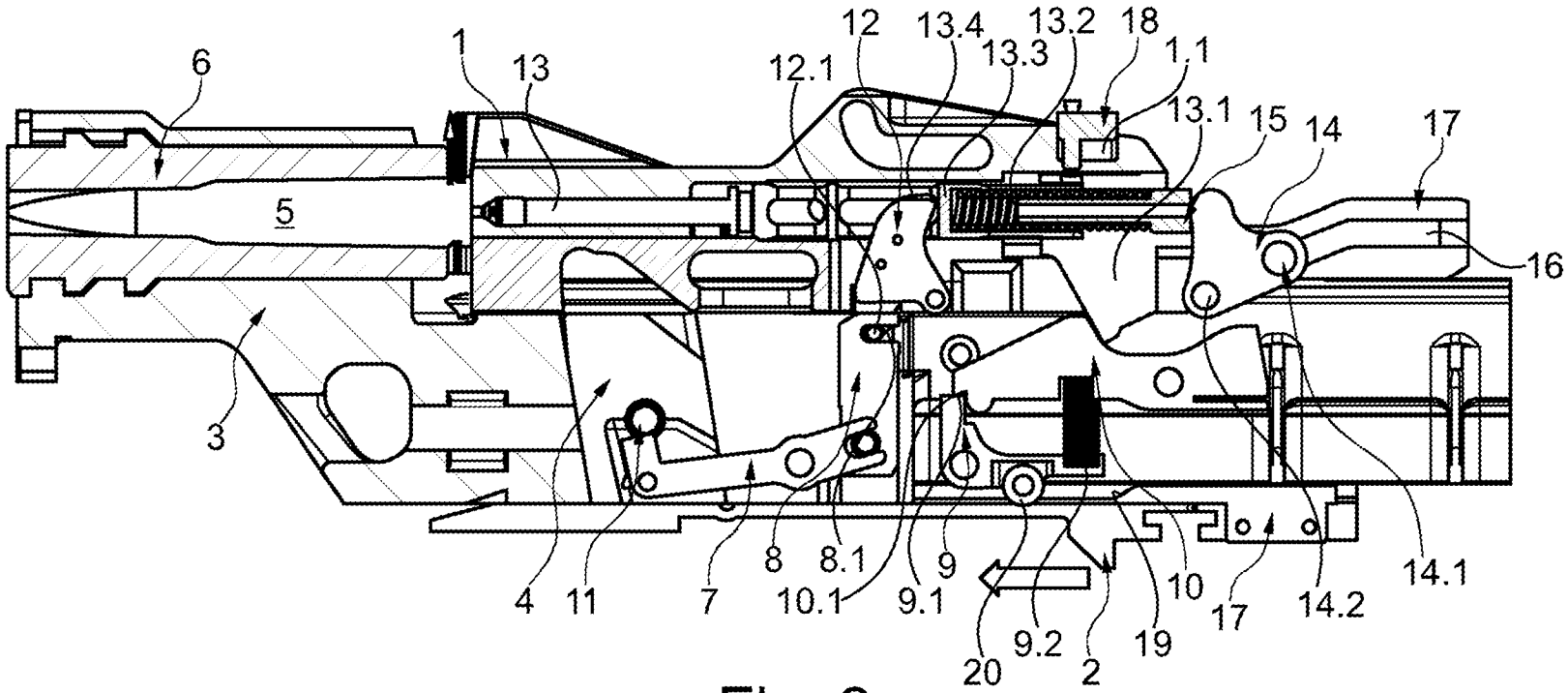
FIG. 2 shows a sectional representation through the weapon during the advancement of a breech.

FIG. 2 shows the breech 1 forward, unlocked. The main components involved in firing a shot from the weapon 100 are in this case a control rocker 7, an elevator 8, a trigger 9 and also a catching pawl 10. The locking latch 4 is coupled with the control rocker 7 by way of a pin 11. Functionally connected to this control rocker 7 is the elevator 8, which with its claws 8.1 engages a first firing pin safety device 12, which lies against a firing pin 13 of the weapon 100 and can be pivoted by the elevator 8. The firing pin 13 comprises a firing pin spring 13.2, which must be tensioned. The firing pin safety device 12 preferably acts on the firing pin 13 before a spring chamber 13.3. For this purpose, the firing pin 13 may have at this point a clearance 13.4, through which the safety device 12 can lie against the firing pin 13. The trigger 9 acts with its catching edge 9.1 against a catching edge 10.1 of the catching pawl 10. The catching pawl 10 is blocked by the trigger 9 as long as the latter engages with its catching edge 9.1 under the catching edge 10.1 of the catching pawl 10. The catching pawl 10 is carried by a spring 9.2 of the trigger 9. The catching pawl 10 is laid before a nose 13.1 of the firing pin 13 and in this position prevents the triggering of the firing pin 13. The catching pawl 10 is (pre)tensioned by way of a spring 9.2 of the trigger 9.

The firing pin 13 comprises a firing pin spring 13.2, which is tensioned by a cocking rocker 14 in interaction with a cocking pushrod 15 during the advancement of the breech 1. The cocking rocker 14 may have an outer contour similar to a heart shape. The cocking rocker 14 by means of a pin 14.1, which forms a cocking pin and is pivotable about a fixed pivot point 14.2. This pivot point 14.2 is located in the lower heart contour, while the pin 14.1 is located in the right side of the heart contour. The pin 14.1 itself is controlled in a cocking cam 16 of a cocking slide 17 along the latter, the cocking rocker 14 being moved about the lower pivot point 14.2. The left side of the heart contour thereby presses onto the cocking pushrod 15 of the firing pin spring 13.2. The firing pin 13 is held in its position by the catching pawl 10, while the cocking pushrod 15 tensions the firing pin spring 13.2 during the advancement of the control slide 2. The safety device 12 releases the firing pin 13 parallel to the locking. The cocking slide 17 is connected to the control slide 2 in such a way that this control slide 2 carries the cocking slide 17 along with it during the advancement of the breech and the return of the breech.

The way in which the firing of a shot functions is to be explained in more detail on the basis of the figures.

The breech 1 is guided from its rear, deactivated position into its front locked position. In its front deactivated position, the control slide 2 runs further. As a result, the pin 11 is transferred in the upward direction in a first front (lower) control cam 2.1 of the control slide 2. With the pin 11, the locking latch 4 is also displaced upward, the breech 1 locked. Combined with this movement, an adjustment of the control rocker 7 takes place in such a way that it pulls the elevator 8 downward. The elevator 8 for its part guides the safety device 12 downward, the latter preferably performing a pivoting movement. The safety device 12 is transferred by the side pins 12.1 of the safety device 12 that engage in the claw 8.1 from the securing position into a triggering position after locking of the breech 1. The safety device 12 is disengaged. The trigger 9 still blocks the catching pawl 10.

It should be mentioned for the sake of completeness that these side pins 12.1 are forcibly guided in guides of the weapon housing during the moving of the breech 1, in order that they act steadily and continuously on the firing pin 13, so that the safety device 12 is engaged during the transport of the breech 1.

In a rear further control cam 2.2 of the control carriage or control slide 2, a further firing pin safety device 18 is guided. This second firing pin safety device 18 may be a connecting rod, which engages in a clearance 1.1 of the breech 1 and in a clearance 13.5 of the firing pin 13. During the forward travel, this connecting rod 18 is retracted from the two clearances 1.1, 13.5 and releases the firing pin 13 after deactivation of the breech 1, and passes on the holding function to the catching pawl 10.

As already mentioned, in the embodiment described the cocking slide 17 is carried along by the control slide 2. Preferably whenever the breech 1 is deactivated and the control slide 2 still runs with the cocking slide 17, the firing pin spring 13.2 is still tensioned, as described.

Figure 3:
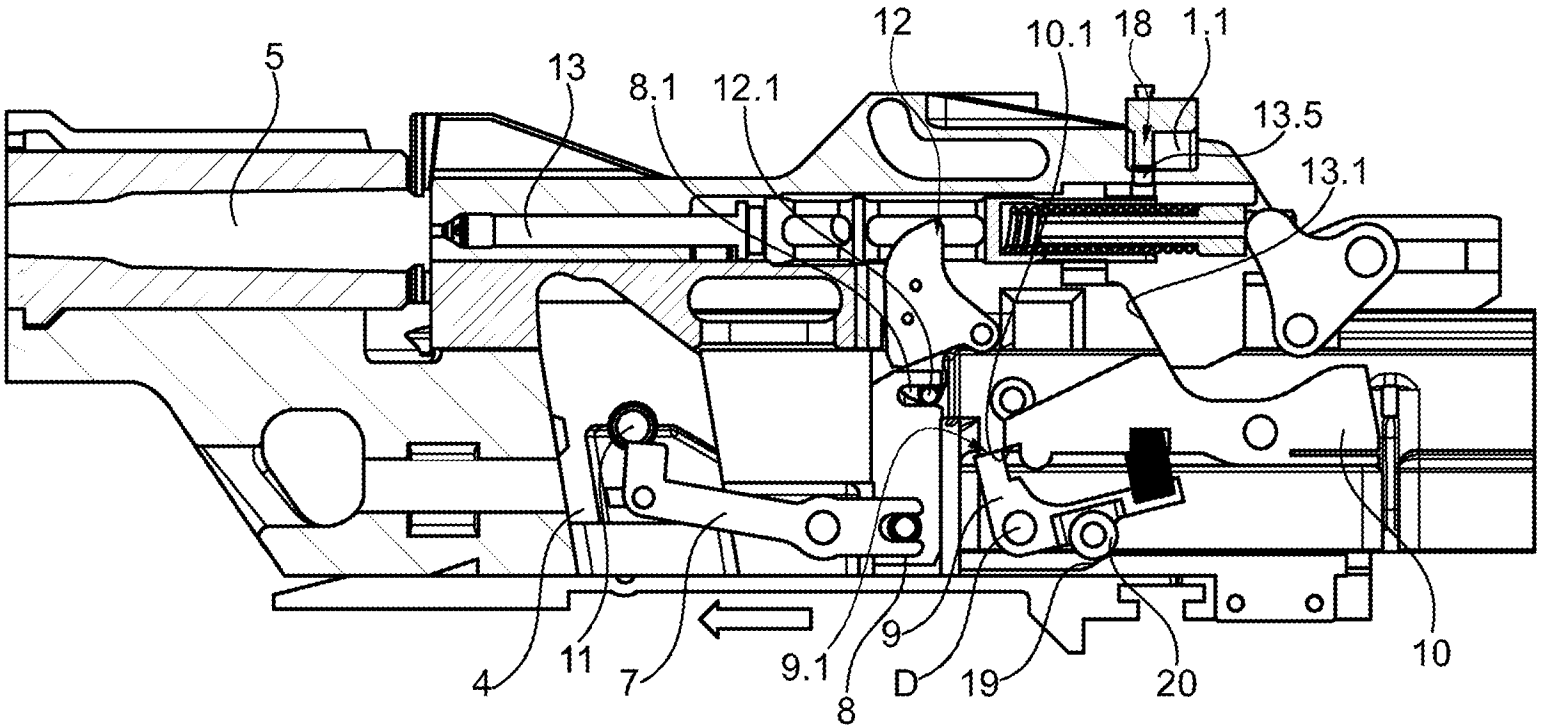
FIG. 3 shows a sectional representation through the weapon shortly before the complete locking of the breech.

A slope or ramp 19 on the cocking slide 2 is responsible for the actual firing of a shot. The ramp 19 determines the triggering time. The later the ramp 19 meets the trigger 9, the later a shot is fired. The ramp 19 presses the trigger 9 upwardly away by means of a roller 20. The catching edge 9.1 of the trigger 9 is pressed by the catching edge 10.1 of the catching pawl 10 and releases the catching edge 10.1 of the catching pawl 10. As a result of the spring pretensioning of the catching pawl 10, the latter slides away and for its part releases the nose 13.1 of the firing pin 13. This firing pin 13, then unsecured in this position, moves forward under spring force of the firing pin spring 13.2 and strikes a primer of the ammunition 5 and ignites it. FIG. 3 shows the breech 1 forward, locked, directly before the firing of a shot.

Figure 4:
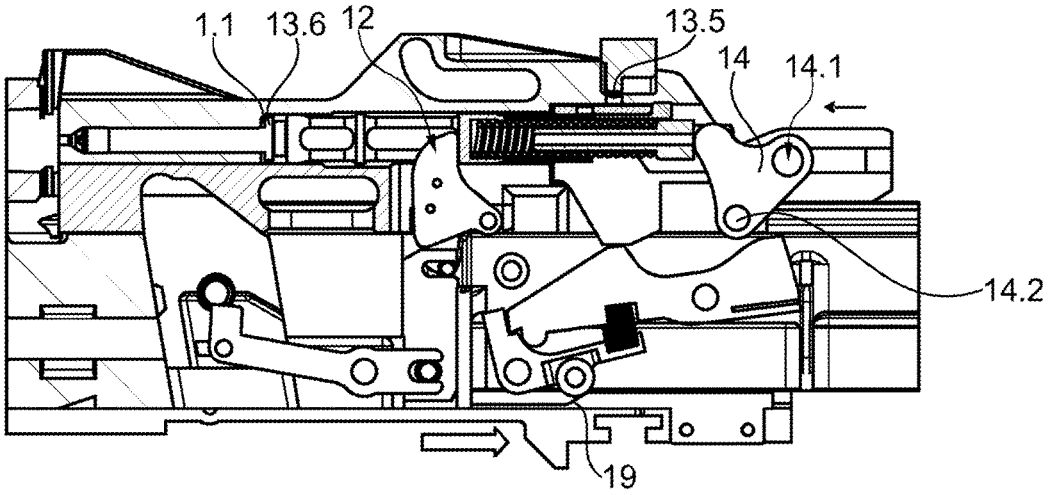
FIG. 4 shows a sectional representation after a shot has been discharged.

In FIG. 4, the firing pin 13 has been fired without a cartridge. The firing pin 13 lies with abutting surface 13.6 against an abutting surface 1.2 in the breech (breech bolt). By way of the firing pin safety device 12, the firing pin 13 is returned to its rear position during the return of the control slide 2. The control slide 2 guides the pin 11 downward, and consequently the locking latch 4 out of the breech 1 (see FIG. 5). The second firing pin safety device 18 is engaged again. The first safety device 12, lying against the firing pin 13, is carried along into the rear position. The catching pawl 10 is pressed downward by the nose 13.1 of the firing pin 13 during the return of the breech 1. At this time, the trigger 9 is no longer engaged from below by the ramp 19. By way of the spring 9.2, the downwardly moved-away catching pawl 10 presses the trigger 9 in its engagement, in which it engages by way of its catching edge 9.1 under the catching edge 10.1. The firing pin spring 13.2 is then completely relaxed during the return of the control slide 2, the cocking rocker 14 being removed from the cocking pushrod 15.

In its rear, deactivated position, a new ammunition 5 is delivered to the breech 1. The next shot can take place.

In a preferred embodiment, the control slide 2 and the cocking slide 17 are however configured as one part. The control cams 2.1, 2.3 and also the cocking cam 16 are integrated in a common slide and functionally complement one another.

It goes without saying that the tensioning of the firing pin spring 13.2 by way of the cocking slide 17 can also take place independently of the control slide 2. What is important is the functional coupling of the locking and opening of the breech with the tensioning of the firing pin spring.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A weapon comprising:

a breech that linearly feeds ammunition to a cartridge chamber of the weapon with a cocking device for a firing pin spring of a firing pin of the weapon, the firing pin being integrated in the breech, the cocking device comprising:

a cocking slide arranged on the weapon, the cocking slide comprising a cocking cam; and a pin of a cocking rocker, which performs a tensioning of the firing pin spring, the firing pin spring being tensioned during advancement of a control carriage, wherein the firing pin is secured by a safety device.

2. The weapon as claimed in claim 1, wherein the safety device is adapted to be engaged and disengaged by way of a control rocker and an elevator, wherein the control rocker and a locking latch of the weapon functionally interact such that, with the breech locked, the safety device is disengaged and, with the breech unlocked, the safety device is engaged.

3. The weapon as claimed in claim 1, wherein the safety device acts on a spring chamber of the firing pin at a clearance provided in the firing pin.

4. A weapon comprising:

a breech that linearly feeds ammunition to a cartridge chamber of the weapon with a cocking device for a firing pin spring of a firing pin of the weapon, the firing pin being integrated in the breech, the cocking device comprising:

a cocking slide arranged on the weapon, the cocking slide comprising a cocking cam; and a pin a cocking rocker, which performs a tensioning of the firing pin spring, the firing pin spring being tensioned during advancement of a control carriage, wherein, for firing a shot, a trigger and a catching pawl which can be actuated by the cocking slide are incorporated, for which purpose the cocking slide has a ramp.

5. The weapon as claimed in claim 4, wherein a catching edge of the trigger lies against a catching edge of the catching pawl, so that the catching pawl is blocked by the trigger as long as the catching edge of the trigger engages under the catching edge of the catching pawl.

6. The weapon as claimed in claim 4, wherein the catching pawl is tensioned by a spring of the trigger.

7. The weapon as claimed in claim 4, wherein the catching pawl is incorporated before a nose of the firing pin and prevents triggering of the firing pin until a complete locking of the breech.

8. A weapon comprising:

a breech that linearly feeds ammunition to a cartridge chamber of the weapon with a cocking device for a firing pin spring of a firing pin spring of the weapon, the firing pin being integrated in the breech, the cocking device comprising:

a cocking slide arranged on the weapon, the cocking slide comprising a cocking cam; and a pin of a cocking rocker, which performs a tensioning of the firing pin spring, the firing pin spring being tensioned during advancement of a control carriage, wherein the cocking slide is connected to the control carriage such that the control carriage carries along the cocking slide during advancement of the breech and during return of the breech.

* * * * *